United States Patent [19]

Thuet

[11] 4,056,182

[45] Nov. 1, 1977

[54] STYLUS ACTUATOR

[75] Inventor: Ronald Kent Thuet, Salt Lake City, Utah

[73] Assignee: Sperry Rand Corporation, New York, N.Y.

[21] Appl. No.: 678,850

[22] Filed: Apr. 21, 1976

[51] Int. Cl.[2] ..... B41J 25/00

[52] U.S. Cl. ..... 197/1 R

[58] Field of Search ..... 197/1 R, 55

[56] References Cited

U.S. PATENT DOCUMENTS

| | | | |
|---|---|---|---|
| 3,845,850 | 11/1974 | Herr et al. | 197/1 R |
| 3,855,448 | 12/1974 | Hanagata et al. | 197/1 R X |
| 3,910,395 | 10/1975 | Colglazier et al. | 197/1 R |
| 3,926,295 | 12/1975 | Adahan | 197/55 |
| 3,981,235 | 9/1976 | Thomas et al. | 197/1 R X |

*Primary Examiner*—Clifford D. Crowder

*Attorney, Agent, or Firm*—John R. Flanagan; Marshall M. Truex

[57] ABSTRACT

A printing stylus actuator comprising a stylus associated with an eccentric shaft which is actuated to move the stylus into and out of contact with a print medium. The eccentric shaft has its center of mass close to its axis of rotation so that when the shaft is rotated, it exhibits low translational inertia to substantially reduce print deformations due to inertia-induced oscillations.

6 Claims, 6 Drawing Figures

STYLUS ACTUATOR

BACKGROUND OF THE INVENTION

In many printing systems the print head must be brought into contact with a print medium during the print cycle and removed from the print medium during the time the print head is being returned to the left margin.

This is particularly true where the printing system is of the non-impact type in which the print head or stylus electrically reacts with the print medium to cause actual printing, e.g., where the stylus comprises a plurality of electrodes and the print medium is coated with a conductive metal.

In this type of printing where the print stylus is removed from the print medium after a line of print is made and placed in contact with the print medium for printing a new line of print, it is critical that oscillations or vibrations of the print stylus be avoided because even very minute oscillations cause print deformations, e.g., character compression or expansion. Such deformations seriously affect the legibility of the printed characters. In addition the oscillations may damage the print stylus as well as the print medium which in turn may affect the print quality.

One chief source of these unwanted oscillations is a stylus actuator arrangement exhibiting high inertia which because of the degree of force required to move a print stylus into contact with a print medium causes the oscillations to occur when the stylus is stopped at the point where it contacts the print medium. The stop must be abrupt to assure that the print stylus stops just at contact with the print medium to avoid damage to the stylus or the print medium.

Typically, such a high-inertia system comprises a stylus carriage mounted to be actuated by a shaft by means of a motor-driven lever wherein the center of gravity of shaft and stylus carriage is at a distance from the area of activation, i.e., separated by the length of a lever. Thus, the center of mass is disposed at a relatively large radius from the axis of rotation which produces a large inertia. Thus, when the stylus actuating shaft is moved so that the print stylus contacts the print medium and is stopped, oscillations are induced in the shaft and, therefore, the stylus carriage and stylus as well, causing print deformations during part of the print cycle. The deformation problem is worse where the stylus is of the electrode type comprising a plurality of wire tips which must rub over the print medium during the print cycle.

The present invention contemplates a stylus actuator wherein the center of mass is concentrated near the axis of rotation, thereby substantially reducing the intertial forces opposing movement of the print stylus into contact with the print medium. More specifically, the present invention contemplates an actuating rod or shaft having a slightly offset axis of rotation. A print stylus-carrying structure is disposed for rotation by the shaft for moving the print stylus into printing contact with the print medium. The eccentricity of the actuating shaft provides sufficient displacement to actuate the stylus-carrying structure while making it possible to actuate the stylus with a relatively small force due to the low inertia offered by the actuating shaft. Thus, oscillation of the actuating rod and, therefore, of the print stylus when it is abruptly stopped at the print position is eliminated. This eliminates print-character distortion due to inertia-induced oscillations of the actuating shaft.

OBJECTS OF THE INVENTION

An object of the present invention is to provide a low-cost, print-stylus actuator requiring a minimum of actuating force.

Another object of the present invention is to provide a print-stylus actuator which exhibits low inertial resistance to actuation allowing for the use of a smaller, lower-cost actuation motor.

A further object of the present invention is to provide an actuator for moving a stylus into and away from contact with a print medium which eliminates print-character deformations due to inertia-induced oscillations.

Other objects and many of the attendant advantages of the present invention will become apparent upon reading the following description in conjunction with the drawings.

DESCRIPTION OF THE INVENTION

Figures 1, 2, 3, 4:
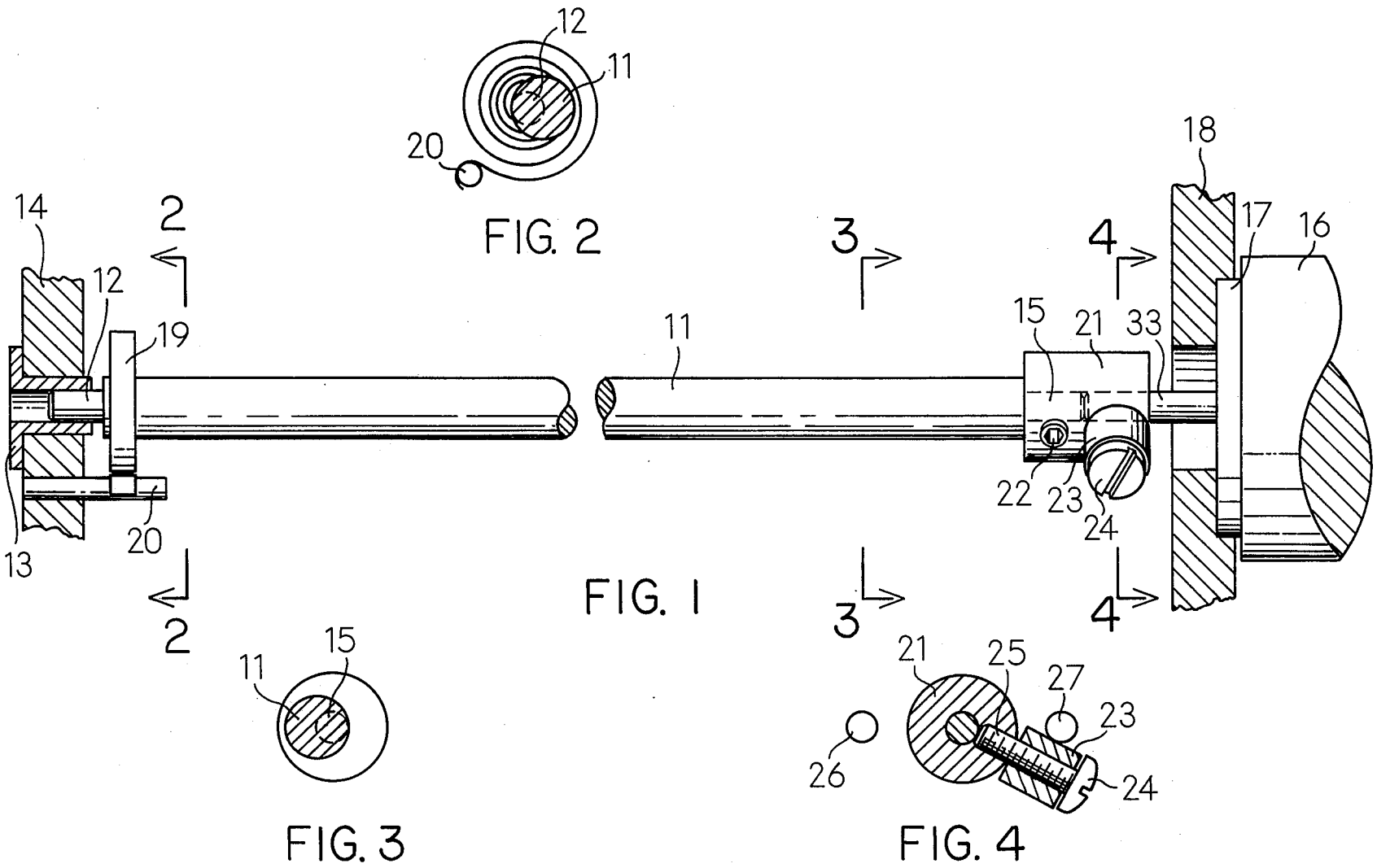
FIG. 1 is a front view of the stylus actuator shaft of the present invention.
FIG. 2 is a view taken along line 2—2 of FIG. 1.
FIG. 3 is a view taken along line 3—3 of FIG. 1.
FIG. 4 is a view taken along line 4—4 of FIG. 1.

Referring now more particularly to FIG. 1, there is shown a shaft 11. The shaft 11 has one end 12 mounted for rotation in a bearing 13 disposed within end wall 14. The other end 15 of the shaft 11 shown in dotted line in FIG. 1 is mounted for rotation by a motor 16. The motor 15 may be secured as by extension 17 within end wall 18. The manner of connection of shaft 15 to the motor-drive shaft 33 is discussed hereinafter.

The ends 12 and 15 of the shaft 11 have smaller diameters than that of shaft 11 and have a common longitudinal axis somewhat displaced from the longitudinal axis of the shaft 11. In a practical embodiment, the distance between the longitudinal axis of the shaft 11 and the common longitudinal axis of the ends 12 and 15 is about one-sixteenth inch while the diameter of shaft 11 may be twice that of the diameter of the ends 12 and 15.

The position of ends 12 and 15 relative to shaft 11 and their relative diameters may be best seen in FIGS. 2 and 3. This relationship provides an eccentric shaft such that when the motor rotates end 15, the shaft 11 rotates on an axis displaced from its own axis.

Figure 5:
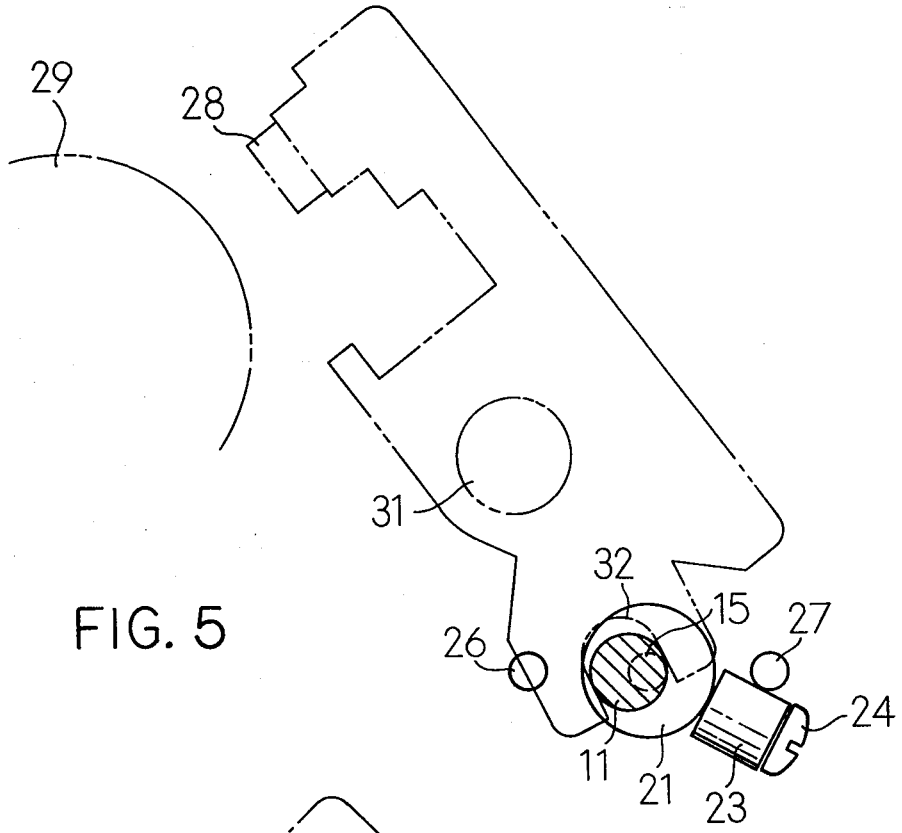
FIG. 5 is a side view of the stylus actuator showing the stylus arm in the non-print position.

As seen in FIGS. 1 and 2, a spiral spring 19 is disposed on the shaft 11 having one end secured thereto and the other end secured to extension 20 which extends from the end wall. The spring 19 biases the shaft in the anti-clockwise direction, looking at shaft 11 fron the left side of FIG. 1. The force of the spring 19 is sufficient to rotate the shaft 11 to the non-print position as shown in FIG. 5 when the motor 16 is not energized. The spring force required to return the shaft 11 to its non-print position is small due to the nearness of the center of mass of the shaft 11 to its axis of rotation.

The end 15 has a coupling 21 which is secured thereto as by a lock screw 22. The coupling connects end 15 to the motor 16 output shaft 33.

A cylinder 23 which extends from the coupling 21 is secured to the coupling 21 as seen in FIG. 4. A screw 24 extends through the cylinder 23 into a threaded opening 25 and fixes the cylinder 23 tightly against the coupling 21. While the cylinder may be made integral with the coupling 21, a practical embodiment employs a cylinder that is easily replaced. The screw 24 and lock screw secure motor shaft 13 to end 15 of shaft 11.

The cylinder 23 is fabricated from a resilient, non-metallic material such as rubber or plastic for sound deadening.

The cylinder 23 serves as an abutment to limit the rotation of the shaft 11 between stops 26 and 27 disposed on the wall 18. The short-arc distance between stops 26 and 27 is approximately 120°. While not shown one or both of the stops 26 and 27 may be adjustable within the wall 18 to vary the short-arc distance. This permits fine adjustment of the limit of rotation of the shaft 11 so that the point of contact of the stylus head 28 with the platen 29 may be precisely controlled to prevent damage to either during movement to the print position. Fine adjustment may also be provided by an adjustment arrangement associated with the print stylus.

Figure 6:
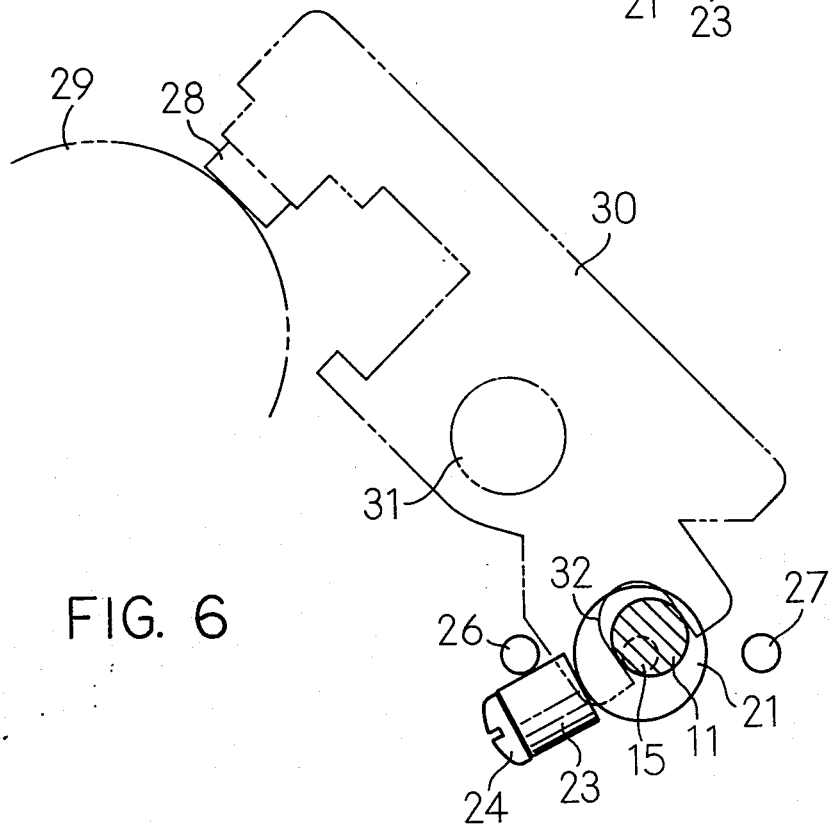
FIG. 6 is a side view of the stylus actuator showing the stylus arm in the print position.

Referring to FIGS. 5 and 6, there is shown a stylus carriage 30. The stylus carriage 30 may be moved through a print line and back by means of a lead screw which is disposed in opening 31 of the stylus carriage 30. While it is not shown, the lead screw normally extends between the end walls 14 and 18 and supports the stylus carriage 30 as well as affords the means for moving the stylus carriage 30 back and forth.

The stylus carriage 30 also utilizes the lead screw to rotate on between the non-print and print positions.

As end of the stylus carriage 30 has a slot 32 which is disposed about the shaft 11 as shown in FIGS. 5 and 6. While the slot 32 fits snugly about the shaft 11, the shaft 11 is free to rotate within the slot 32.

The other end of the stylus carriage 30 has a print head or stylus 28 fixed thereto so that when the stylus carriage 30 is in the print position as shown in FIG. 6, it contacts the platen 29. Naturally, during actual printing, a print medium (not shown) is disposed between the print stylus 28 and the platen 29.

In the non-print position as shown in FIG. 5, the cylinder 23 abuts stop 27 and is held in this position by the bias of the spring 19.

When the motor 16 is energized, the motor shaft 33 which is attached to the end 15 through coupling 21 turns the shaft 11 in the clockwise direction until the cylinder abuts the stop 26 as seen in FIG. 6. The position of stop 26 is exactly positioned so that the print stylus 28 contacts the platen 29 in the appropriate manner.

Due to the eccentricity of the shaft 11, its clockwise rotation within the slot 32 causes the stylus carriage 30 to rotate counterclockwise on the lead screw disposed in opening 31 until the cylinder 23 encounters stop 26 and is stopped thereby.

When the motor 16 is de-energized, the shaft 11 is caused to rotate counterclockwise within the slot 32 by the spring 19 until the cylinder 23 is stopped by the stop 27. Thus, spring 19 automatically returns the stylus carriage 30 to the non-print position shown in FIG. 5 whenever the motor 16 is de-energized.

To rotate shaft 11 to the print position requires the motor 16 to have torque to overcome the bias of spring 19 and the inertia of the system. However, this inertia is quite small because the center of mass of the shaft 11 is so near its axis of rotation. Because of the low inertia and, therefore, the low torque, the force with which cylinder 23 hits the stop 26 is insufficient to produce oscillations in the shaft 11 or any part of the system to cause print-character deformation due to undesired movement of the stylus 28 relative to the platen 29 or print medium.

Other modifications of the present invention are possible in light of the above description which should not be construed as placing limitations on the invention beyond those in the claims which follow.

What is claimed is:

1. A stylus actuator comprising in combination:

a stylus carriage having a print head at one end, said stylus carriage adapted to rotate between print and non-print positions;

a slot disposed in the other end of said stylus carriage;

shaft means disposed within said slot, said shaft means comprising a shaft having a first longitudinal axis, first and second extensions integrally formed at opposite ends of said shaft means and having a diameter smaller than that of said shaft means, said first and second extensions having a common longitudinal axis displaced from said first longitudinal axis of said shaft means, such that when said shaft means is rotated the axis of rotation is said common longitudinal axis of said first and second extensions, such that rotation of said shaft means in a first direction causes said stylus carriage to rotate to said print position and rotation of said shaft means in a second direction causes said stylus carriage to rotate to said non-print position;

bearing means for rotationally supporting said first extension;

motor means having a drive shaft connected to said second extension for rotating said shaft means;

spring means disposed on said shaft means normally biasing said shaft means to said non-print position whereby when said motor means is de-energized said shaft means is rotated to the non-print position;

a coupling disposed on said shaft means;

an extension extending radially outward from said coupling;

first stop means disposed in the path of said extension for limiting movement of said stylus carriage in said first direction and into said print position; and second stop means disposed in the path of said extension for limiting movement of said stylus carriage in said second direction and into said non-print position.

2. A stylus actuator according to claim 1 wherein said shaft means has a center of mass slightly displaced from the axis of rotation of said shaft means and said coupling connects said other end of said shaft means to said drive shaft of said motor.

3. A stylus actuator comprising in combination:

a stylus carriage having a print head at one end, said stylus carriage adapted to rotate between a first and a second position;

a slot disposed in the other end of said stylus carriage;

shaft means disposed within said slot, said shaft means comprising a shaft having a first longitudinal axis, first and second extensions integrally formed at opposite ends of said shaft ends and having a diameter smaller than that of said shaft means, said first and second extensions having a common longitudinal axis displaced from said first longitudinal axis of said shaft means, such that when said shaft means is rotated the axis of rotation is said common longitudinal axis of said first and second extensions such that rotation of said shaft means in a first direction causes said stylus carriage to rotate to said first position and rotation of said shaft means in a second direction causes said stylus carriage to rotate to said second position;

bearing means for rotationally supporting said first extension;

motor means for rotating said shaft means;

a coupling disposed on said shaft means;

an extension extending radially outward from said coupling;

first stop means disposed in the path of said extension for limiting movement of said stylus carriage in said first direction and into said first position; and, second stop means disposed in the path of said extension for limiting movement of said stylus carriage in said second direction and into said second position.

4. A stylus actuator as set forth in claim 3 wherein said shaft means has a center of mass slightly displaced from the axis of rotation of said shaft means.

5. A stylus actuator as set forth in claim 3, including spring means disposed on said shaft means for normally biasing said shaft means to said second position whereby when said motor is de-energized said shaft means is rotated to said second position.

6. A stylus actuator comprising in combination:

a stylus carriage having a print head at one end, said stylus carriage adapted to rotate between a first and a second position;

shaft means coupled to said stylus carriage for rotating said shaft means in a first direction and rotating said stylus carriage into said first position and for rotating said shaft means in a second direction and rotating said stylus carriage into said second position;

means for rotationally supporting said shaft means;

a coupling disposed on said shaft means;

an extension extending radially outward from said coupling;

first stop means disposed in the path of said extension for limiting movement of said stylus carriage in said first direction and into said first position; and, second stop means disposed in the path of said extension for limiting movement of said stylus carriage in said second direction and into said second position.

* * * * *